United States Patent [19]

Baxter et al.

[11] Patent Number: 4,620,935

[45] Date of Patent: Nov. 4, 1986

[54] ACTIVATION OF AQUEOUS HYDROGEN PEROXIDE WITH MANGANESE CATALYST AND ALKALINE EARTH METAL COMPOUND

[75] Inventors: Paul L. Baxter, Widnes; Iain S. MacKirdy; Christopher T. Wright, both of Warrington, all of England

[73] Assignee: Interox Chemicals Limited, London, England

[21] Appl. No.: 701,750

[22] Filed: Feb. 14, 1985

[30] Foreign Application Priority Data

Jun. 6, 1984 [GB] United Kingdom ..... 8414488
Jan. 30, 1985 [GB] United Kingdom ..... 8502375

[51] Int. Cl.[4] ..... C11D 3/395; C11D 3/39; C11D 7/18

[52] U.S. Cl. ..... 252/99; 8/107; 252/94; 252/95; 252/186.33; 252/186.38; 252/186.41

[58] Field of Search ..... 252/95, 94, 99, 186.33, 252/186.38, 186.41; 502/324; 8/107, 111

[56] References Cited

U.S. PATENT DOCUMENTS 969,073 8/1910 May ..... 252/186.41
2,245,495 6/1941 Pemble ..... 252/186.38
3,210,284 10/1965 Duvall ..... 252/80
4,430,242 2/1984 Bragg ..... 252/91
4,481,129 11/1984 Oakes ..... 252/186.41

FOREIGN PATENT DOCUMENTS 1280456 10/1968 Fed. Rep. of Germany .
553004 5/1943 United Kingdom .
199837 7/1967 U.S.S.R. .
671835 7/1979 U.S.S.R. .

*Primary Examiner*—Prince E. Willis
*Attorney, Agent, or Firm*—Larson and Taylor

[57] ABSTRACT

It has been suggested hitherto that the bleaching performance of hydrogen peroxide or persalts developing it in situ at ambient to hand hot (e.g. up to 60° C.) temperatures can be enhanced by addition of a transition metal catalyst, but recent investigations revealed that when manganese is selected as catalyst its performance can range from nil enhancement to a substantial improvement.

The present invention is based upon the recognition that manganese catalysis of hydrogen peroxide is promoted by the presence of at least an equimolar amount of calcium, barium or strontium compound, and preferably a molar ratio of at least 50:1.

35 Claims, No Drawings

ACTIVATION OF AQUEOUS HYDROGEN PEROXIDE WITH MANGANESE CATALYST AND ALKALINE EARTH METAL COMPOUND

The present invention relates to bleaching and washing compositions containing either hydrogen peroxide or a persalt which can generate hydrogen peroxide in aqueous solution, and more particularly to such compositions that contain additionally a transition metal activator to promote the washing or bleaching activity of the hydrogen peroxide.

For many years, hydrogen peroxide or persalts that generate it in aqueous solution have either been incorporated in bleaching or washing compositions or sold as a bleach additive for use in conjunotion with hydrogen peroxide-free washing compositions partioularly to oxidatively remove hydrophilic stains. Hydrogen peroxide and persalts generating it are most effective at bleach or wash temperatures approaching boiling point of the aqueous solution containing them, and oonsequently for their effective use substantial volumes of water need to be heated to such temperatures. The past decade has witnessed a dramatic rise in the cost of heating and has promoted a resurgence of research into methods of promoting the activity of hydrogen peroxide at significantly lower wash/bleach temperatures such as from ambient to 60° C. One approach has been to seek to harness the known interaction between various transition metal ions and hydrogen peroxide that otherwise contribute markedly to the in situ decompositions of the peroxygen compound.

Interest has focused upon the first row transition metal ions, of which three in particular have been highlighted namely iron, copper and manganese. Their use as a hydrogen peroxide activator has been reported in several patents around twenty years ago, such as US-A-3156654, but this patent asserts that the metals must be used in conjunction with certain chelating agents that meet closely defined operating criteria. A critical criterion is that the chelating agents must not be stronger complexing agents than is the material to be bleached. However, of the complexing agents described, most fall within the class of amino carboxylic acids. In the course of investigating the effectiveness of manganese as an activator for hydrogen peroxide bleach/washing systems, comparative tests were conducted on hydrophilic stains under buffered alkaline conditions at a luke warm temperature; one test employed hydrogen peroxide alone as the bleach and a second test employed hydrogen peroxide, manganese and an amino carboxylate under otherwise identical conditions. Within the limits of accuracy of the stain removal tests, both tests remove the same extent of stain and accordingly it can be deduced that the disclosure in the aforementioned American patent specification is of dubious applicability to manganese aotivation systems. In more recent times, there is described in EP-A-72166 a multi-component activator system based upon a primary transition metal activator, and auxiliary metals such as zinc or aluminium and a strong complexing agent including amino carboxylates of the aforementioned American patent specification. The European specification, however, provides only qualitative instead of quantitative assertions rather than any actual results. Its principal difference from the aforementioned American specification is the presence of the auxiliary metal. When an auxiliary metal such as zinc or aluminium ions were employed together with manganese for the purpose of activating hydrogen peroxide bleach systems, under test conditions described above, neither zinc nor aluminium ions had any discernable positive effect upon the stain removal and indeed both had a marked deleterious effect. The picture is further complicated in that in American specification U.S. Pat. No. 3,532,634, it is asserted that the amino carboxylates that are demanded both by U.S. Pat. No. 3,156,654 and EP-A-72166 are rejected as being unsuitable chelating agents because they are too strong in persalt (hydrogen peroxide) bleaching systems containing a transition metal activator and a chelating agent and additionally an organic activator which can generate an organic peroxy acid.

Most recently, it is alleged in European patent specification No. EP-A-82563 that carbonate ions enhance the catalytic activity of manganese for hydrogen peroxide in wash/bleach solutions and that the effect increases consistently with increasing levels of carbonate. The results listed include direct comparisons between compositions otherwise identical in which sodium carbonate has been substituted for sodium tripolyphosphate either completely or to a specified proportion. Continuing research has indicated very strongly that sodium tripolyphosphate is a suppresant for the activation by manganese of hydrogen peroxide in bleach conditions. Accordingly, the aforementioned results in reality demonstrate the effect of progressive removal of a suppresant whilst apparently demonstrating the benefit of increased carbonate concentration. For the purpose of understanding the manganese activation system more completely, trials were conducted using simplified process systems, namely using a source of hydrogen peroxide, a source of the compounds alleged to promote manganese catalysis and distilled water on a standard set of stains in a standard laboratory washing apparatus. These tests demonstrated no promotion of manganese catalysis to any marked extent even when carbonate was employed as the promotor.

It will be recognised from the foregoing passages that in at least one respect the prior publications relating to metal ion catalysis of hydrogen peroxide for bleaching/washing are mutually contradictory in their teaching as to what components may or may not promote the hydrogen peroxide activation and that even where apparently clear and unambiguous teaching is given, when that teaching is applied in respect of manganese systems, a surprising failure to reproduce the results has occured. It can be deduced, therefore, that the prior publications do not provide a clear teaching on how to obtain reproducably and assuredly activation of hydrogen peroxide in bleaching/washing using manganese ions.

It is an object of the instant invention in at least some embodiments to provide catalyst compositions for activating hydrogen peroxide or persalts that ameliorate or overcome the problems of reproducability of activation referred to hereinbefore. Similarly, it is a further object of some embodiments of the present invention to provide bleach additive compositions containing such an aforementioned catalyst composition together with a persalt or hydrogen peroxide suitable for use in conjunction with a persalt-free washing compositions, and in some other embodiments to provide washing compositions containing the catalyst composition and a persalt. It is a yet further object of various embodiments of the present invention to provide bleaching or washing processes employing a catalyst system and hydrogen peroxide, added as such or generated in situ.

Surprisingly, it has been found that the activation of hydrogen peroxide/persalts by manganese under conditions of use is dependent upon the presence of certain alkaline earth metal compounds.

According to one aspect of the present invention there is provided a catalyst composition for the activation of hydrogen peroxide or persalts comprising a manganese compound and at least an equimolar amount of a soluble alkaline earth metal compound selected from calcium, barium or strontium compound.

It will be recognised that by the term "soluble" herein is meant that the compound is sufficiently soluble to deliver at least an equimolar concentration of the alkaline earth metal ions into solution.

According to a second aspect of the present invention there is provided a bleach additive composition comprising the aforementioned catalyst composition and at least twenty moles of hydrogen peroxide or persalt per mole of manganese.

In a further aspect of the present invention there are provided washing compositions comprising at least 1% of the aforementioned bleach additive compositions, (calculated on the basis of the peroxygen and catalyst content), from 1 to 70% of 1 or more surfactants, from 0 to 70% of one or more compatible non-phosphatic builders, from 0 to 40% of an alkali metal sulphate or chloride filler, and from 0 to 20% detergent adjuvants.

It will be recognised from the foregoing that even though it is an alkaline earth metal, the list of promotors for manganese excludes magnesium. In practice, if it is substituted for the three desired alkaline earth metal salts the resultant stain removal can be markedly impaired not only in comparison with addition of comparable amounts of a desired alkaline earth metal salt, but even in comparison with the addition of the manganese compound alone. Accordingly, the presence of the magnesium is detrimental to the manganese activation prooess. Consequently, when reference is made hereinafter to alkaline earth metal compounds for the promotion of manganese activation, it will be understood that it refers solely to compounds of calcium, barium or strontium and not to berylium or magnesium.

Superimposed upon any change in stain removal resulting from a change in the amount of manganese compound used, the promotional effect of the alkaline earth metal compound increases progressively as its mole ratio to manganese increases. Accordingly, it is preferable to employ at least 10 moles of alkaline earth metal compound per mole of manganese. In respect of soluble manganese salts it is more beneficial to employ a mole ratio of at least 50:1. In many embodiments, the total alkaline earth metal compound:manganese salt ratio is at least 75:1. It will be recognised, however, that very similar promotion of manganese occurs at all ratios of calcium:magnesium in excess of 75:1. In practice, for soluble manganese it is often convenient to employ an alkaline earth metal:manganese mole ratio of less than 1000:1 and in many embodiments the mole ratio is less than 500:1 and indeed in many instances falling within the range of 80:1 to 300:1. Since it is often more desirable to use rather higher molar amounts of insoluble manganese compound than when using soluble manganese, the observed mole ratio of calcium to manganese tends to be selected in a lower but overlapping range for insoluble manganese oxide/hydroxides than for the soluble salt, so that the mole ratio Ca:Mn is often at least 15:1 upwards, and in many instances up to 100:1.

It is recognised that some water supplies used for washing or bleaching processes can themselves contain residual levels of calcium that are in excess of any residual levels of magnesium, both of which are major contributors to the so-called hardness of water supplies. Under normal circumstances, the presence in solution of calcium and magnesium interferes significantly with detergency and multifunctional sequestering agents such as polyphosphates and pyrophosphates are conventionally employed in order to sequester the hardness cations, so that hitherto it has been recommended that such water be softened before use. Advantageously, it has been found that even where the water supply contains an excess of calcium hardness over magnesium hardness, an improvement in the calcium promotion of manganese activation can be obtained by the use of compositions that introduce further calcium or other alkaline earth metal compound together with the manganese salt. Accordingly, the present invention ensures that manganese activation of peroxides persalts can be achieved or improved, irrespective of the nature of the water supply, and whether or not prior to use in washing/bleaching processes the water supply has been subjected artificially to softening.

Several preferred alkaline earth metal compounds have a substantial water solubility and are selected from alkaline earth metal chloride, bromide or iodide, and the water-soluble carboxylic acid salts such as acetate or propionate, or nitrates or nitrites. It is especially preferred to employ the calcium salt, not only because it is the lightest of the three and thus the most effective on a weight basis, but also because it is in any event the most effective on a molar basis. The most preferred compounds are calcium chloride and calcium nitrate. Various of the alkaline earth metals compounds can exist either in anhydrous form or in various degrees of hydration. By way of example calcium chloride can exist as the anhydride or as a mono, di- or hexahydrate and the nitrate as the anhydrous or tetrahydrate salts. For the avoidance of doubt, the compounds may be employed either as hydrated salts or in anhydrous form. However, if the compositions contain additionally persalts that may suffer accelerated decomposition as a result of storage in humid conditions, prudence dictates that where possible the anhydrous or the kinetically most stable hydrated compound be employed.

The manganese compound used in compositions and processes according to the present invention can conveniently be derived from any soluble manganese salt such as manganous sulphate, chloride or nitrate or from any manganese compound or substrate which can deliver manganese (ii) ions in aqueous solution. Such a substrate can comprise an absorbent particulate or non-particulate substrate which previously has absorbed a manganous salt. Non particulate substrates include fibres, foams, sponges and films that often are made from cellulose ether, alginates, polyvinyl alcohols or polyvinyl pyrrolidone polymers. Particulate substrates can include manganous exchanged zeolites A and Y. Some variation in the extent of manganese activation is noticeable as the salt delivering manganese into solution is varied. Insoluble manganese oxides and hydroxides can be used to provide all or part of the manganese catalyst.

The ratio between soluble and insoluble manganese catalyst is at the discretion of the user.

The insoluble manganese oxide/hydroxide preferably is incorporated into oompositions or washing solutions in the form of a powder, advantageously of particle size below 0.25 mm, and conveniently from 0.02 to 0.125 mm.

Bleach additive compositions containing manganese, alkaline earth metal and hydrogen peroxide or a persalt usually contain the manganese and promotor compounds in the ratio stated before and at least 20 moles of hydrogen peroxide persalt per mole of manganese. In most bleach additive compositions, the mole ratio of the persalt/hydrogen peroxide to manganese is not greater than 10,000:1, and in many instances is selected within the range of 200:1 to 5000:1. In the case of hydrogen peroxide-containing compositions, it is expected that such compositions would be produced either by simultaneous introduction of the components into a wash water or by introduction of the solid manganese and promotor compounds into a more concentrated hydrogen peroxide solution immediately prior to its use. The solid formulation can naturally be stored as a particulate mixture, or in the form of granulates, tablets, extrudates, or the like. The range of persalts that can be employed includes, in particular, sodium perborate tetrahydrate, sodium perborate monohydrate, or trihydrate, sodium percarbonate (sodium carbonate perhydrate) urea peroxide, or adducts of hydrogen peroxide with sodium sulphate and either sodium or potassium chloride. It will be recognised by virtue of the widely differing molecular weights of such compounds, the weight ratios of the persalt or hydrogen peroxide to manganese compound and alkaline earth metal compound will also vary widely. In many embodiments, however, the weight ratios of the three components will be selected with the following ranges:

Manganese compound—1 to 10 parts per weight, alkaline earth metal compound—140 to 1400 parts per weight and persalt 600 to 10,000 parts by weight. The preferred ranges are respectively 1.5 to 6; 300 to 1000; 2000 to 7500. An alternative way of viewing the bleach or bleach additive composition is to regard it as a mixture of persalt and catalyst composition, in a weight ratio in many practical embodiments of from 2:1 to 70:1, and particularly from 3:1 to 20:1, with the catalyst composition itself containing normally from 0.1% of manganese compound up to 2%, and especially from 0.25% to 1% %s of manganese being based on the weight of the catalyst composition.

In addition to the essential components aforementioned, the bleach or bleach additive compositions can include one or more of the components detailed hereinafter in the context of washing compositions. Thus, they can contain alkalis such as for example sodium carbonate or various silicates particularly to provide bleach pH of around 10 or processing acid/filler such as sodium sulphate, the various other detergent adjuvants for the same purposes as in the full washing formulations at the discretion of the formulator. In many instances, the total proportion of persalt plus catalyst composition within the bleach or additive composition is at least 10% w/w, a convenient range often being from 25 to 75% w/w. Indeed, the compositions can include as desired a wetting agent which typically is an anionic or nonionic surfactant, often in a small proportion such as up to 5% w/w. Such compositions clearly overlap with washing compositions which in this specification indicates the presence of a surfactant.

In the further aspect of the present invention, the bleach additive or bleach oompositions are incorporated within washing compositions.

The content of persalt plus catalyst in the washing composition is often at least 5% and generally 10 to 60%, especially 15% to 50% w/w.

The surfactants that can be employed in the present invention include anionic, nonionic, zwitterionic or cationic surfactants or mixtures thereof, which are suitable for incorporation in persalt-containing washing compositions. In practice they are selected to exhibit water solubility.

The anionic surfactants are normally alkali metal, especially sodium or sometimes potassium salts, or ammonium salts, or, if desired, a part thereof can be in the form of calcium salts, thereby simultaneously contributing to the detergency of the system whilst providing calcium to promote the manganese activation. One or more anionic surfactants are often selected from linear alkyl benzene sulphonates, especially having $C_9$–$C_{15}$ in the alkyl chain, alkyl sulphates, particularly $C_{10}$–$C_{22}$, olefin sulphonates, particularly $C_{10}$–$C_{24}$, alkane and/or hydroxyalkane sulphonates, often $C_{10}$–$C_{24}$, alkyl phenoxy ether sulphates, often with $C_8$–$C_{12}$ alkyl chain and 1–10 ethylene oxide units, alkyl ether sulphates often with $C_{10}$–$C_{20}$ alkyl chain and 1–10, preferably 2–4 ethylene oxide units and soaps, particularly $C_{12}$–$C_{20}$. Various other anionic surfactants often provide at least part of the total added including sulphocarboxylates, alkyl glyceryl ether sulphonates, monoglyceride sulphates and sulphonates, and phosphated ethylene oxide-based nonionic surfactants.

The nonionic surfactants for incorporation in invention washing compositions generally comprise condensation products of ethylene oxide and propylene oxide, typically 5–30 units, with an aliphatic or aromatic alcohol or an aliphatic acid amine or amide. In such nonionic surfactants, the hydropholic aliphatic moiety often has a chain length of $C_8$–$C_{22}$ in wholly aliphatic compounds or is $C_6$–$C_{12}$ when present in an alkyl aromatic group. Other usable nonionic surfactants are condensates of glycerol and sorbitol.

It is convenient, usually to employ both an anionic surfactant component and a nonionic surfactant component in washing compositions, in a weight ratio often from 10:1 to 1:10.

Semipolar surfactants are useable herein and include water-soluble amine oxides, phosphine oxides and sulphur oxides, each containing a $C_{10}$–$C_{22}$ alkyl chain and often 2 $C_1$–$C_3$ alkyl chains.

Zwitterionic surfactants herein are often selected from water-soluble derivatives of aliphatic quternary ammonium, phosphonium and sulphonium cationic compounds in which the aliphatic moieties are straight or branched, and in which one substituent is $C_8$–$C_{18}$ and one terminates in an anionic water-solubilizing group, especially a sulphonate group for example alkyl-hydroxy-propane-sulphonates and alkyl-dimethyl-ammonio-hydroxy- propane-sulphonates.

The cationic surface active agents when employed are often selected from quaternary ammonium compounds having one or two $C_8$–$C_{20}$ straight or branched hydrophobic groups, e.g. cetyl trimethyl ammonium bromide or chloride, dioctadecyl dimethyl ammonium chloride, and the fatty alkyl amines.

It will be understood that various builders that are commonly employed in washing compositions including alkali metal tripolyphosphates, tetrapyrophosphates and the various salts of amino carboxylic acid complexing builders have been shown to interfere with, sometimes even totally, manganese catalysed hydrogen peroxide stain bleaching, even in the presence of the specified alkaline earth metal salt promotors. It will be further understood that to varying extents, even the other known builders will remove calcium from the washing environment, and therefore can also impede to a certain extent the calcium promotion effect, but that for such builders, the rate of uptake of calcium or the calcium residual in the process water is normally such that the promotion by calcium suffers only a partial rather than a total or nearly total interference. Accordingly, such other builders can be tolerated to a much greater extent than can tripolyphosphate, tetrapyrophosphate or amino carboxylic acid salts. Accordingly, it is advantageous for the washing compositions to be in essence phosphate-free, that is to say contain no substantial amounts of any of the phosphate builders or amino carboxylic acids in builder quantities. Naturally, it is recognised that amounts can be used of even phosphate or aminocarboxylic acid builders which leave uncomplexed sufficient alkaline earth metal to promote manganese catalysis and indeed may be beneficial in small amounts, for example less than 1% when added for other purposes.

It is preferable for the detergent builders to be selected from water-soluble or insoluble particulate builders including alkali metal silicates, zeolites that obey the general formula $(M_2O)_x.(Al_2O_3).(SiO_3)_y$ in which M is a monovalent metal especially sodium, x is 0.7 to 1.5 and y is 1.3 to 4.0, including zeolites A and X and mixtures thereof, alkali metal carbonate/bicarbonates, and alkali metal citrates, as described in copending British Patent Appliation No. 8405189. Such builders are regarded as compatible. It will be recognised that a plurality of these builders may be employed in varying ratios at the discretion of the washing composition formulator. Indeed, and by way of example only such builder mixtures can include mixtures of carbonates with silicate, carbonates with citrates, and citrates with silicates, or all three, silicate indicating in itself either water-soluble alkali metal silicates or particulate zeolite materials or any mixture thereof in all instances as desired In many practical washing compositions, the overall builder concentration will range from 30 to 70% of the total composition.

When a processing aid (filler) is present, it is preferably sodium sulphate and inclusion of alkali metal chloride as filler can also be tolerated.

The detergent auxiliary agents present are normally selected from soil antiredeposition agents, dye transfer inhibitors, optical brightening agents, peroxy stabilisers, corrosion inhibitors, bactericides, foam enhancers, foam inhibitors, thickeners, absorbents, abrasives, diluents, dyes, perfumes and proteolytic enzymes. Amongst the auxiliary agents, carboxymethyl cellulose salts and polyvinylpyrrolidines deserve mention as SARDs, especially at 0.5 to 2% w/w. very low levels of the various aminocarboxylates. aminomethylenephosphonates, hydroxy quinolines and dipicolinic acid as peroxy stabilisers and/or dye transfer inhibitors, silicates for corrosion inhibition, quaternary ammonium or pyridinium halides as bactericides, alkanolamides and ethylene oxide/propylene.oxide copolymers to regulate foaming. Derivatives of diaminostilbene sulphonic acid, diarylpyrazolines and aminocoumarins are examples of OBA's, anhydrous sodium or magnesium sulphate are examples of absorbents and diluents, and silica or kieselguhr as abrasives. Naturally, it is preferred to select dyes and perfumes known not to interact readily with peroxygen compounds, and to coat any enzyme with water soluble/dispersible coating for storage protection.

The processes for washing articles according to the present invention can be carried out at a temperature from ambient temperature up to the boiling point of the washing solution. Compositions according to the present invention are particularly well suited to a process at which washing or bleaching is carried out by steeping at ambient or by heating the solution from ambient to a temperature selected in the range of from about 25° to 60°. Alternatively the washing and bleaching prooesses may be effected by heating up a cold washing solution. A combination of processes can be used, such as cold steeping followed by a wash at 30°, 40° or 50° C. Naturally, a variety of process combinations can be used. Thus, in one set of combinations a solution of the bleach composition, buffered to alkaline pH can be employed as a pre-wash treatment, either by steeping at ambient or in a short wash cycle at up to 60° C. followed by a wash using a fully formulated detergent composition, which may be a composition as described herein or different.

In general, the rate of removal of stains is enhanced by employing a higher temperature within the range of ambient to 60° C. and by higher Avox. concentrations, but by virtue of the rate at which the invention washing compositions dissolve or are dispersed in the wash solution, the contact period between solution and fabric can conveniently be as short as 5 minutes. Longer periods of for example typically 10 to 30 minutes and up to 1 hour tend to provide greater soil removal. In cold washing or steeping even longer periods can be employed, such as steeping overnight.

It is desirable in such washing processes for sufficient of the catalyst composition be introduced to provide a concentration of manganese of from 2 micromoles to 50 micromoles per liter, and especially desirably from 5 to 20 micromoles manganese per liter. By so doing, it is possible thereby to obtain the benefit of manganese catalysis of hydrogen peroxide bleaching, whilst avoiding to a substantial or entire extent impaired cloth reflectance which it is believed is associated with subsequent manganese precipitation upon the material being washed or bleached. Advantageously, the wash solution appears to tolerate more readily variation in the amount of manganese introduced in the form of a particulate insoluble oxide or hydroxide, than when the same molar amount is addedd as a water-soluble salt. Accordingly, the upper limit for addition can be increased to 100 micromoles Mn per liter and the preferred range widened to 10 to 60 micromoles Mn per liter. When both soluble and insoluble manganese compounds are used the amounts of each are in accordance with their respective individual limits. At the same time, it is preferable to introduce into solution at least 250 micromole of alkaline earth metal compound per liter, and preferably from 500 to 5000 micromole of the alkaline earth metal compound per liter. Of course, in large scale operations, it is possible to operate a system in which the process water is sampled from time to time, its calcium ion concentration determined and allowances thereby made as a result of the monitoring to determine how much additional calcium or other alkaline earth metals compound it is desirable or preferred to add separately from the process water. Domestically, though, such a process is impractical at present. The concentration of hydrogen peroxide or persalt introduced into the washing or bleach solution is preferably at least 2 millimoles per liter and in practice is normally from 5 to 25 millimoles per liter.

The concentration of washing composition used either in conjunction with the activated bleach composition or alternatively containing the catalyst and persalt, can be employed over a very wide range of ooncentrations. Even when used in domestic washing machines a wide range of concentrations may be employed depending upon the prevelant local practices, including in particular the ratio of liquor to weight of articles being washed. Thus, the range currently envisaged spans from 0.5 g/l per liter of washing composition up to 25 g/l. It will accordingly be recognised that the concentration of catalyst in those compositions destined for use at very low liquor ratios is preferably somewhat lower than those compositions destined for the American market with long liquor ratios, often by a factor of about 5 to 10.

Having described the invention in general terms, specific demonstrations of the effectiveness of the catalyst promotion system are given herein solely by way of example and that persons skilled in the art of bleaching will be able to make variations thereupon in accordance with the foregoing disclosure without departing from the spirit of the invention.

COMPARISON 1 AND EXAMPLES 2 TO 8

In this Comparison and these Examples, swatches of a red wine stain cotton cloth were washed for 20 minutes in an aqueous alkaline solution buffered to pH 10 with sodium hydroxide and containing 330 mg/l hydrogen peroxide (calculated as 100%, 970 micromoles per liter) and 9 micromoles per liter of manganese chloride. In addition, the wash solution contained the concentration of calcium according to Table 1 below, added as calcium chloride. The washing trials were carried out at 40° C. in a laboratory scale washing machine available from the US Testing Corporation bearing their Trademark TERGOTOMETER (Registered in some countries). After each swatch had been washed, it was rinsed with cold water, air dried and its reflectance ($R_w$) was measured using an Instrumental Colour Systems MICROMATCH (Trademark) reflectance spectrophotometer equipped with a xenon lamp light source, filtered to approximate to daylight. The reflectance was compared with the reflectances of the cloth before it was stained ($R_c$) and the stained cloth before washing ($R_s$) measured in the same way and the percentage stain removal was calculated using the formula $$\% \text{ stain removal} = 100 \times (R_w - R_c)/(R_s - R_c).$$

Results are summarised in Table 1.

TABLE 1

| Comparison/Example No. | Calcium/Manganese mole ratio | % Stain Removal |
|---|---|---|
| C1 | 0 | 45 |
| 2 | 1 | 52 |
| 3 | 10 | 58 |
| 4 | 50 | 66 |
| 5 | 100 | 69 |
| 6 | 250 | 70 |

From Table 1 it can be seen that as the mole ratio of calcium to manganese increased, the % stain removal progressively increased and that especially good removal was obtained with calcium to manganese mole ratios of 50:1 or higher. In Examples 7 and 8, the washing process of Examples 3 and 5 respectively were repeated, but in the additional presence of sodium citrate in an equimolar ratio to the calcium. The percentage stain removals were respectively 55% in Example 7 and 62% in Example 8. This demonstrates that the presence of the builder could be tolerated in that the resultant effect was still markedly higher than in the absenoe of the catalyst/promotor system.

The approximate weight %s of calcium chloride in the calcium/manganese catalyst composition oorresponding to Examples 2 to 6 were respectively (calculated as the anhydrous salts) 46%, 90%, 98%, 99%, 99.5%.

EXAMPLES 9 TO 11 AND COMPARISONS 12 TO 16

The promotional or demontional effect of various auxiliary metals on manganese activation of hydrogen peroxide was tested employing the general method of Example 5, that is to say adding the auxiliary metal in a mole ratio to the manganese at 100:1 in demineralised water solution, but using a different but similar batch of red wine-stained swatches The one exception to this was Comparison 14 in which the mole ratio of magnesium to manganese was 200:1. With the exception of strontium and aluminium, which were added as the nitrate salt, all the other metals were added as the chloride The results are summarised in Table 2 below.

TABLE 2

| Comparison/Example | Auxiliary Metal | % Stain Removal |
|---|---|---|
| 9 | Calcium | 65 |
| 10 | Barium | 62 |
| 11 | Strontium | 54 |
| C12 | None | 46 |
| C13 | Zinc | 33 |
| C14 | Magnesium | 32 |
| C15 | Cadmium | 30 |
| C16 | Aluminium | 24 |

From Table 2 it can be recognised that calcium, barium and strontium all were effective promotors of manganese catalysed hydrogen peroxide bleaching, whereas zinc, magnesium, cadmium and aluminium all demoted the bleaching effect by a substantial extent. The comparison between magnesium and the other alkaline earth metal salts is particular striking. It demonstrates that where magnesium is present in hard water supplies, further and additional calcium or barium or strontium should be added in order to compensate for that demotional effect.

EXAMPLES 17 TO 20

In these Examples, the promotional effect of the various combinations of manganese and calcium salts were tested, employing the apparatus, wash time, temperature and pH conditions of the foregoing Examples and Comparisons on yet further swatches of red wine-stained cotton. All of the Examples were carried out employing 9 micromoles per liter of manganese salt, and 2500 micromoles per liter of calcium salt and 970 micromoles per liter hydrogen peroxide, the process being carried out in distilled water. The absolute % stain removal as well as the gain in stain removal over the corresponding comparison in which the process was repeated in the absence of alkaline earth metal salt are shown in Table 3 below.

TABLE 3

| Example No. | Mn/Ca salts | % stain removal | Gain in Stain Removal |
|---|---|---|---|
| 17 | $MnSO_4/CaCl_2$ | 60 | 19 |
| 18 | $MnSO_4$ $Ca(NO_3)_2$ | 62 | 21 |
| 19 | $MnCl_2/CaCl_2$ | 66 | 20 |
| 20 | $Mn(NO_3)_2/Ca(NO_3)_2$ | 67 | 19 |

From Table 3 it can be seen that all combinations were being very effective and the most effective promotion/activation was achieved with a combination of both manganese and calcium nitrate.

EXAMPLES 21 TO 24

In these Examples, the gain in stain removal was measured when employing the catalyst system in hard water. Sufficient catalyst/promotor composition was introduced into solution to provide 9 micromole per liter manganese, added as manganese chloride and either 450 or 900 micromole per liter calcium, added as calcium chloride into hard water supplies containing respectively either 100 or 250 parts per million hardness, calculated as calcium carbonate and comprising a 3:1 mole ratio of calcium to magnesium. The trials were carried out on red wine-stained swatches of cotton at 40° C. and for a 20 minute wash, employing sodium perborate tetrahydrate as oombined active oxygen bleach and pH adjuster, without any further control as to the pH. The procedures were otherwise as in the previous Examples. The results summarised in Table 4.

TABLE 4

| Example No. | Water Hardness | Mole ratio Mn:Ca added | % stain Removal | Gain in stain Removal |
|---|---|---|---|---|
| 21 | 100 | 50:1 | 62 | 3 |
| 22 | 100 | 100:1 | 64 | 5 |
| 23 | 250 | 50:1 | 64 | 5 |
| 24 | 250 | 100:1 | 63 | 4 |

From Table 4, it can be seen that even when the water supply contained initially a substantial degree of hardness, namely between 100 and 250 parts per million hardness, calculated as calcium carbonate, a further gain in stain removal was achieved when additional alkaline earth metal salt was added together with the manganese catalyst. In the absence of catalyst approximately 41% stain removal was achieved.

EXAMPLE 25

This Example demonstrates that the promotional effect occurs when sodium percarbonate is employed as the bleaching agent. The process and test conditions of Example 5 was repeated, but with all the bleach being provided by sodium percarbonate, and with no other pH adjustment agent being included. The addition of calcium chloride in at a mole ratio of 100:1 to the manganese catalyst (manganese nitrate) resulted in a gain in stain removal of from 46% in its absence to 65% in its presence, i.e. a gain of 19%. It will be recognised also that such an addition of sodium percarbonate is comparable to a concentration of around 0.75 g/l of sodium carbonate, which is one of the builders that can be tolerated in the instant invention system.

The bleach additive composition to provide sodium percarbonate, calcium chloride and manganese nitrate in solution in the approximate proportions described in this Example is as follows:

Sodium percarbonate: 89.5%
Calcium chloride dihydrate: 10.3%
Manganous nitrate tetrahydrate: 0.18%

EXAMPLE 26

In this Example, washing was effected in the presence of a substantially phosphate-free washing composition. Red wine-stained cotton cloth was washed for 10 minutes at 32° C. in an aqueous alkaline solution formed by the dissolution in distilled water of sodium perborate tetrahydrate at 1.26 g/l and a substantially phosphate-free detergent base at 1.5 g/l having the analysis given below, being available from Procter & Gamble under their Trademark TIDE.

TABLE 5

| Constituent | % w/w in Composition |
|---|---|
| Anionic surfactants | 12–13 |
| Nonionic surfactants | 3 |
| Phosphate builders | 0.5 |
| Carbonate builder | 20 |
| Silicate (as zeolite) | 27 |
| (as sodium silicate) | 3 |
| Filler (sodium sulphate) | 27 |
| Adjuvants (SARD, OBA, etc) | 4 |
| Water | balance |

The catalyst system was employed at a concentration of micromole per liter manganese and 900 micromole per liter calcium, and in all cases, the wash solution was measured as pH 10.6.

The presence of the calcium promotor enabled just in excess of 34% of the stain to be removed under those very mild washing conditions, whereas in its absence, only 29% could be removed.

This demonstrates, therefore, that in the presence of surfactants and substantial concentrations of the tolerable builders and filler, the promotion of manganese by alkaline metals is still a significant factor.

The three component bleach additive system to employ with the detergent base comprised sodium perborate tetrahydrate 90.4% w/w (approx), calcium chloride dihydrate 9.5% w/w (approx) and manganous chloride tetrahydrate 0.13% w/w.

COMPARISONS A TO I AND EXAMPLES 27 TO ÷

In these Comparisons and Examples, further swatches of a red wine stain cotton cloth were washed for 20 minutes in an aqueous alkaline solution buffered to pH 10 with sodium hydroxide and containing 350 mg/l hydrogen peroxide (calculated as 100%, 1030 micromoles per liter) and the number of micromoles per liter of manganese powder specified in Table 6. The manganese powders had a particle size of below 0.075 millimeteres. In addition, in the Examples the wash solutions contained calcium chloride dihydrate (130 mg/l, 885 micromoles Ca per liter). The washing trials were carried out at 40° C. in the TERGOTOMETER washing machine. Stain removal was determined the same way as in preceding Examples.

Results are summarised in Table 6.

TABLE 6

| Comparison Example No | Manganese compound | addition micromoles Mn per liter | Calcium salt | % Stain Removal |
|---|---|---|---|---|
| A | — | — | − | 33 |
| B | $Mn_2O_3$ | 12.5 | − | 33 |
| 27 | $Mn_2O_3$ | 12.5 | + | 42 |
| C | $Mn_2O_3$ | 50.0 | − | 33 |
| 28 | $Mn_2O_3$ | 50.0 | + | 45 |
| D | $Mn_3O_4$ | 13.1 | − | 33 |
| 29 | $Mn_3O_4$ | 13.1 | + | 47 |
| E | $Mn_3O_4$ | 52.4 | − | 36 |
| 30 | $Mn_3O_4$ | 52.4 | + | 41 |
| F | $MnO_2$ | 11.2 | − | 37 |
| 31 | $MnO_2$ | 11.2 | + | 41 |
| G | $MnO_2$ | 45.0 | − | 34 |
| 32 | $MnO_2$ | 45.0 | + | 44 |
| H | OMnOH | 11.1 | − | 34 |
| 33 | OMnOH | 11.1 | + | 40 |
| I | OMnOH | 44.4 | − | 36 |
| 34 | OMnOH | 44.4 | + | 42 |

From table 6, it can be seen that the addition of the manganese compound alone resulted in virtually no bleach activation whereas when a calcium salt was also added, bleach activation was consistently obtained.

We claim:

1. A bleach or bleach additive composition comprising a catalyst composition consisting essentially of (a) a manganese compound and (b) at least an equimolar amount of soluble alkaline earth metal compound selected from soluble calcium, barium, or strontium compounds, and at least 20 moles of hydrogen peroxide or a persalt per mole of manganese.

2. A composition according to claim 1 in which the mole ratio of alkaline earth metal to manganese is at least 10:1.

3. A composition according to claim 1 wherein said manganese compound is soluble.

4. A composition according to claim 1 wherein said manganese compound is insoluble.

5. A composition according to claim 3 in which the mole ratio of alkaline earth metal to soluble manganese compound is at least 50:1.

6. A composition according to claim 4 in which the mole ratio of alkaline earth metal to insoluble manganese compound is at least 15:1.

7. A composition according to claim 1 in which the alkaline earth metal compound is selected from chlorides, bromides or nitrates.

8. A composition according to claim 3 in which the alkaline earth metal compound is selected from calcium chloride, bromide or nitrate present in a mole ratio to the soluble manganese compound of 50:1 to 500:1.

9. A composition according to claim 4 in which the alkaline earth metal compound is selected from calcium chloride, bromide or nitrate present in a mole ratio to the insoluble manganese compound of 20:1 to 60:1.

10. A composition according to claim 3 in which the manganese compound comprises a water-soluble salt selected from manganous suplhate, chloride or nitrate.

11. A composition according to claim 4 in which the manganese compound comprises a water-insoluble oxide or hydroxide.

12. A composition according to claim 1 in which the alkaline earth metal comprises calcium.

13. A composition according to claim 1 pertaining from 200 to 5000 moles of hydrogen peroxide of persalt per mole of manganese.

14. A composition according to claim 1 which is storable and comprises a particulate mixture of the catalyst composition and the persalt.

15. A composition according to claim 1 in which the persalt is selected from sodium perborate monohydrate or tetrahydrate or sodium percarbonate.

16. A composition according to claim 1 comprising manganese compound, alkaline earth metal compound and persalt in parts by weight of respectively: 1 to 10; 140 to 1400; and 600 to 10000.

17. A composition according to claim 16 in which the manganese compound is selected from manganous sulphate, chloride and nitrate, the alkaline earth metal compound comprises calcium or barium chloride, bromide or nitrate and the persalt comprises sodium perborate monohydrate or tetrahydrate or sodium percarbonate.

18. A composition according to claim 1 comprising a particulate mixture of persalt and catalyst composition in a weight ratio of 3:1 to 20:1.

19. A composition according to claim 1 or 16 containing additionally one or more magnesium- and phosphate-free filler or alkali.

20. A washing composition comprising: at least 1% of a bleach composition comprising a catalyst composition consisting essentailly of (a) a manganese compound and (b) at least an equimolar amount of souble alkaline earth metal compound selected from soluble calcium, barium, or strontium compounds, and at least 20 moles of hydrogen peroxide or a persalt per mole of manganese; from 1 to 70% surfactant; from 0 to 70% non-phosphate compatible builder; and from 0 to 20% detergent auxiliaries.

21. A composition according to claim 20 containing 5 to 40% of the bleach composition.

22. A composition according to claim 20 in which the builder is selected from alkali metal silicates, aluminosilicates, carbonates or citrates.

23. A process for the activation of bleaching or washing employing hydrogen peroxide comprising the steps of forming an aqueous alkaline solution of hydrogen peroxide and providing in said solution a catalytic amount of a manganese compound and at least an equimolar amount of a soluble alkaline earth metal compound selected from calcium, barium or strontium compounds.

24. A process according to claim 23 which is effected at a temperature of from ambient to 60° C.

25. A process according to claim 23 which is effected at a pH of from 8 to 11.

26. A process according to claim 23 which is effected by introducing into solution aqueous hydrogen peroxide or a solid persalt that generates hydrogen peroxide in situ, alkali where necessary and a catalyst composition comprising the manganese compound and selected alkaline earth metal compounds.

27. A process according to claim 23 which is effected by introducing into solution a preformed bleach or bleach additive composition containing a persalt, manganese compound and said alkaline earth metal compound.

28. A process according to claim 26 or 27 which is effected in conjunction with introduction into said solution of a washing composition.

29. A process according to claim 23 which is effected by introduction of a washing composition containing a surfactant, persalt, manganese compound, and said alkaline earth metal compound.

30. A process according to claim 26 in which the hydrogen peoxide or persalt is present in a washing composition substantially free of phosphate and amino carboxylate builders.

31. A process according to claim 23 in which the manganese compound comprises a soluble manganese salt, and in which the concentration of the soluble manganese salt in the aqueous washing or bleaching solution is from 2 to 20 micromoles per liter.

32. A process according to claim 31 in which the alkaline earth metal compound is present in a molar ratio to the soluble manganese salt of from 50:1 to 500:1.

33. A process according to claim 31 in which the manganese compound comprises an insoluble manganese oxide or hydroxide and in which the manganese oxide or hydroxide is added to the bleach solution in an amount of up to 100 micromoles Mn per liter.

34. A process according to claim 33 in which the insoluble manganese oxide or hydroxide is added to the bleach solution in an amount of 10 to 60 micromoles Mn per liter.

35. A process according to claim 31 in which the concentration of hydrogen peroxide or persalt introduced is from 2 to 20 millimoles per liter.

* * * * *